US005214904A

United States Patent [19]

DePoint et al.

[11] Patent Number: 5,214,904

[45] Date of Patent: Jun. 1, 1993

[54] FLEXIBLE APPARATUS AND PROCESS FOR PLACING PACKAGES OF DIFFERENT SIZES IN SLEEVE TYPE BOXES

[75] Inventors: John DePoint, Palmyra; Michael L. Koelsch, Rochester, both of N.Y.; Dean R. Molstad, Sussex; Vincent J. Panzarella, Greenfield, both of Wis.

[73] Assignee: Eastman Kodak Company, Rochester, N.Y.

[21] Appl. No.: 810,983

[22] Filed: Dec. 20, 1991

[51] Int. Cl.[5] ..... B65B 5/06; B65B 7/28; B65B 43/40

[52] U.S. Cl. ..... 53/468; 53/169; 53/251

[58] Field of Search ..... 53/169, 540, 531, 147, 53/252, 251, 250, 249, 313, 314, 315, 316

[56] References Cited

U.S. PATENT DOCUMENTS

| | | | |
|---|---|---|---|
| 2,361,366 | 10/1944 | Bell | 226/82 |
| 2,598,809 | 6/1952 | Liebl | 93/49 |
| 3,022,615 | 2/1962 | Schroeder et al. | 53/37 |
| 3,111,885 | 11/1963 | Perrelli | 93/49 |
| 3,214,887 | 11/1965 | Weller | 53/116 |
| 3,513,623 | 5/1970 | Pearson | 53/61 |
| 3,708,951 | 1/1973 | Folk et al. | 53/75 |
| 3,872,644 | 3/1975 | Giraudi et al. | 53/52 |
| 3,977,161 | 8/1976 | Faber et al. | 53/313 |
| 4,117,646 | 10/1978 | James et al. | 53/488 |
| 4,179,111 | 12/1979 | Gunther, Jr. et al. | 270/68 |
| 4,272,943 | 6/1981 | Russell | 53/492 |
| 4,279,611 | 7/1981 | Labombarde et al. | 493/418 |
| 4,340,380 | 7/1982 | Calvert | 493/316 |
| 4,480,423 | 11/1984 | Muller | 53/266 |
| 4,517,791 | 5/1985 | Focke | 53/566 |
| 4,674,261 | 6/1987 | Sabel | 53/242 |
| 4,683,706 | 8/1987 | Harper | 53/485 |
| 4,726,170 | 2/1988 | Sawa et al. | 53/570 |
| 4,750,955 | 6/1988 | Haguenier | 156/69 |
| 4,896,480 | 1/1990 | Blumle | 53/485 |

*Primary Examiner*—James F. Coan
*Attorney, Agent, or Firm*—Charles E. Snee, III

[57] ABSTRACT

Packages (10) are assembled with sleeve type boxes having a receptacle portion (14) and a closure portion (24) in a process and apparatus which guide the packages between a fixed guide (52) and a movable guide (50) into a receptacle portion held in the jaws of a grasping device (66), after which the partially completed product is moved along a path (62) into engagement with a closure portion held at an angle to the path by a grasping and holding device (64) which rotates the closure portion into telescopic engagement with the receptacle portion as the two portions move along the path (62). A programmable robot (56) is used to pick up matched pairs of closure and receptacle portions, engage the closure portions with grasping and holding device (64) and engage the receptacle portions with grasping device (66); and, after insertion of a package, the matched pairs are reassembled.

16 Claims, 10 Drawing Sheets

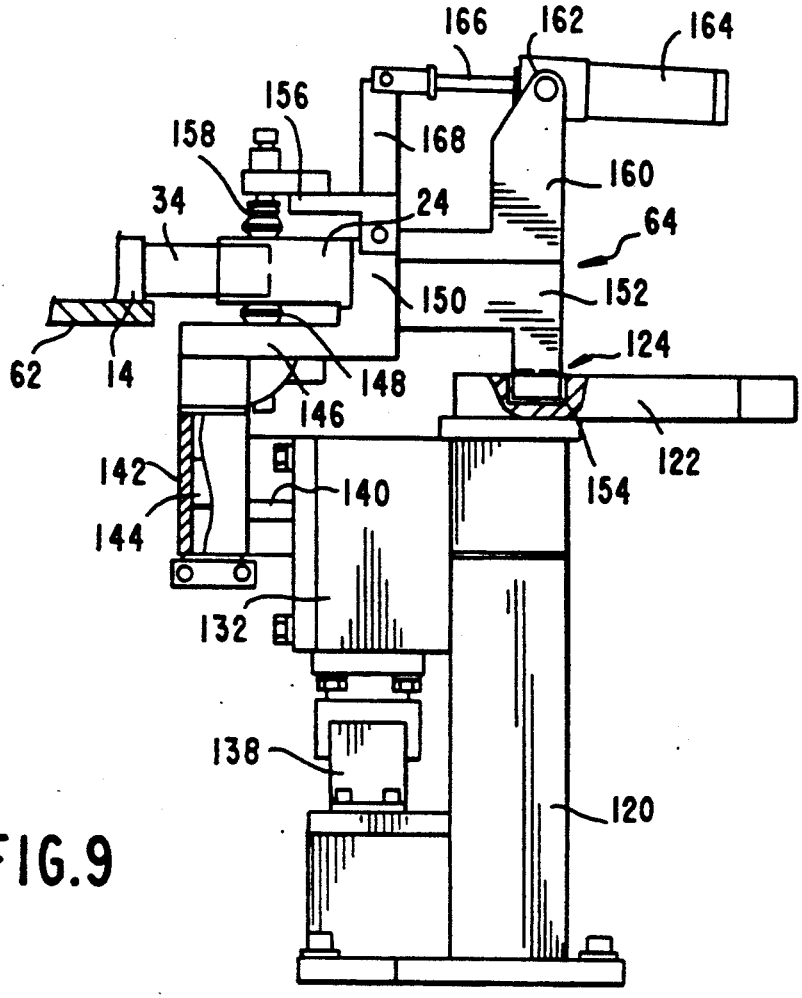
FIG.9
FIG.12
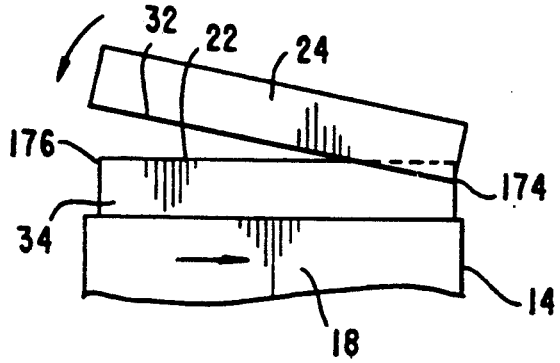

FLEXIBLE APPARATUS AND PROCESS FOR PLACING PACKAGES OF DIFFERENT SIZES IN SLEEVE TYPE BOXES

TECHNICAL FIELD

This invention relates to apparatus and processes for placing packages or arrays of packages in sleeve type boxes with tight fitting telescopic lids. More particularly, the invention is concerned with such apparatus and processes which are flexible or readily adjustable, so that packages or arrays of different sizes can be inserted into corresponding boxes of different sizes, without requiring complicated adjustment or reconfiguration of the apparatus or process.

BACKGROUND ART

Apparatus and processes have been known for many years for assembling containers of the type comprising a receptacle portion and a closure portion. U.S. Pat. Nos. 2,361,366; 3,214,887; and 4,683,706 disclose apparatus for assembling jars and lids in which the leading edge of each jar engages a lip on a randomly selected lid held in a magazine and set at an angle to the direction of movement of the jar; so that, the lid is pulled from the magazine due to engagement with the jar and then drops over the mouth of the jar. U.S. Pat. No. 3,022,615 shows an apparatus for conveying arrays of objects to a position for insertion into a box, in which the arrays are positioned, regardless of the size of the array, against a fixed guide prior to insertion. U.S. Pat. No. 4,896,480 discloses a method and apparatus for placing a loose, shallow cover on a box, in which a randomly selected lid held in a magazine and set at an angle to the direction of movement of the box is gripped at one end and tilted into the path of movement of the box while the other end of the lid remains in the magazine, after which the box engages the lid and pulls it from the magazine, causing the lid to drop over the mouth of the box.

For certain types of products, such as packs of photographic film or paper, it is important that the box for the product have a tightly fitting cover to minimize the potential for entrance of light, dust and moisture. Thus it has been common practice to package such products in sleeve type boxes with tight fitting telescopic lids of the type illustrated in FIGS. 1 and 2. A package 10 to be boxed may comprise in the well-known manner a stack of sheets of photographic film within an evacuated pouch. Typically, such a package is provided, at its end which will be first removed from the box, with a flap 12 which is folded over onto the package prior to boxing, as shown in phantom in FIG. 2. The sleeve type box or container for the package comprises a receptacle portion 14 having a bottom wall 16, a peripheral wall portion 18 and a mouth 20 surrounded by an edge 22. Receptacle portion 14, in the case of boxes for photographic products, is sized to closely surround package 10 and is made from a stiff cardboard which is light impervious. A lid or closure portion 24 is provided for the container and comprises a top wall 26, a peripheral wall 28 and a mouth 30 surrounded by an edge 32. Typically, as illustrated in FIGS. 1 and 2, peripheral wall portion 18 of receptacle portion 14 is relieved along a band 34 of 2 to 3 inches in width around mouth 20; so that, mouth 30 can tightly, telescopically receive a portion of peripheral wall portion 18. The depth of engagement between receptacle portion 14 and closure portion 24, particularly in the case of photographic products, preferably is the same for all sizes of products, to give equal protection against the ingress of light or dust. To ensure a tight fit between receptacle portion 14 and closure portion 24, the two are co-manufactured as a matched pair, thereby minimizing excessively tight or loose fits which inherently would result from tolerance mismatches if the receptacle portions and closure portions were made separately and randomly matched at assembly.

As indicated in FIGS. 1 and 2, package 10 is inserted into receptacle portion 14 and then closure portion 24 is assembled to receptacle portion 14. When portions 14,24 are provided as a matched pair, as is preferred for photographic materials, automation of the steps of removing the closure portion, holding the receptacle portion, inserting package 10 and finally reassembling the container has proven difficult, with the result that such operations frequently are done manually. Apparatus are known for removing the closure portion from such a matched pair, inserting a package and then slipping the closure portion in a straight line path back onto the receptacle portion. In such known apparatus, however, slight misalignments between the receptacle portion and the closure portion can lead to an interference fit which jams the apparatus or damages the product. Furthermore, when various sizes of packages 10 are to be inserted into correspondingly sized containers, existing apparatus generally requires a rather complicated readjustment or reconfiguration whenever the sizes change. Because of the width of relief band 34 and the tight fit of the matched portions, engagement of receptacle portion 14 with closure portion 24 during assembly must be carefully controlled, to prevent the closure from becoming cocked relative to the receptacle, which can lead to jamming and damage to the container.

SUMMARY OF THE INVENTION

The apparatus and process of the invention are particularly well suited for placing packages or objects in a sleeve type box or container of the type previously described. Assembled pairs of matched receptacle portions and closure portions are stored in any suitable manner. Means, such as a programmable robot, are used to remove an assembled container from storage and present the container to a means for grasping and holding the closure portion while the robot withdraws the receptacle portion. Meanwhile, each object is conveyed or otherwise moved along a first path adjacent a fixed guide which positions the object for insertion into its container, without regard to the size of the object. Preferably, a moveable guide is provided on the opposite side of the first path to provide easy adjustment for changes in the size of the objects. The receptacle portion of the container is positioned by the robot with its mouth facing along the first path to receive the object from between the guides. One side edge or other reference feature, such as a corner, of each receptacle portion is placed at a fixed position relative to the fixed guide, without regard to the size of the container. Means preferably are provided for holding the mouth of the receptacle portion open to ease insertion of the object. Once the object has been inserted, the receptacle portion is conveyed along a second path with the edge of its mouth substantially parallel to the second path. The matched closure portion of the container is positioned by the means for grasping and holding with its mouth spread open and with the edge of its mouth at an angle to the second path; so that, the leading corner of the receptacle portion will enter the mouth of the closure portion. The means for grasping and holding then moves with the receptacle portion along the second path. Simultaneously, the means for grasping and holding is caused to rotate in a precisely controlled manner as movement progresses along the second path; so that, the mouth of the closure portion rotates into telescopic engagement with a portion of the receptacle portion.

BRIEF DESCRIPTION OF THE DRAWINGS

FIG. 9 shows a side elevation view of the apparatus of FIG. 8, as viewed from the right in FIG. 8.

FIG. 12 is a fragmentary view showing how a closure portion is engaged by and then rotated onto a receptacle portion.

DESCRIPTION OF THE PREFERRED EMBODIMENTS

Figure 1:
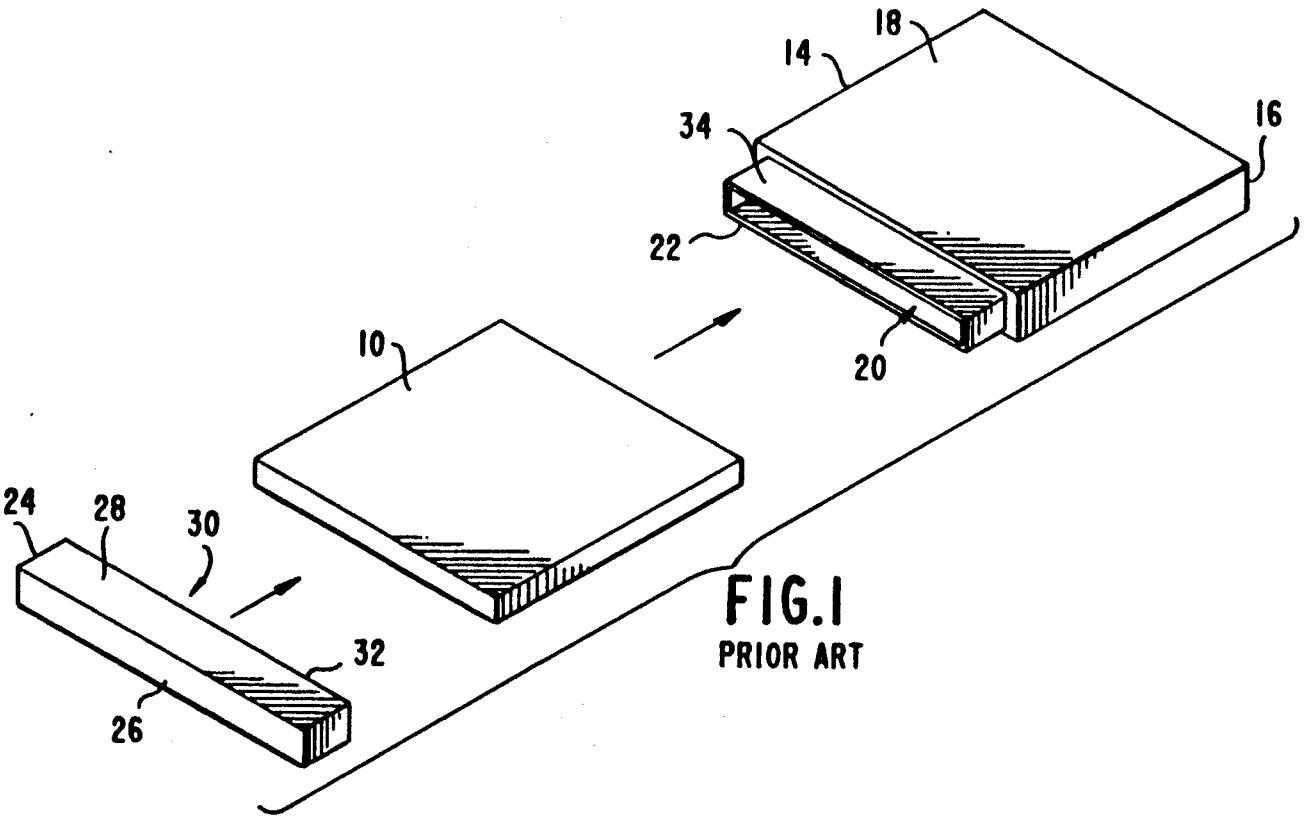
FIG.1 PRIOR ART
FIG. 1 shows an exploded perspective view of a type of container and package which can be assembled in accordance with the invention.

The following is a detailed description of the preferred embodiments of the invention, reference being made to the drawings in which the same reference numerals identify the same elements of structure in each of the several Figures.

OVERALL OPERATION

Figure 3:
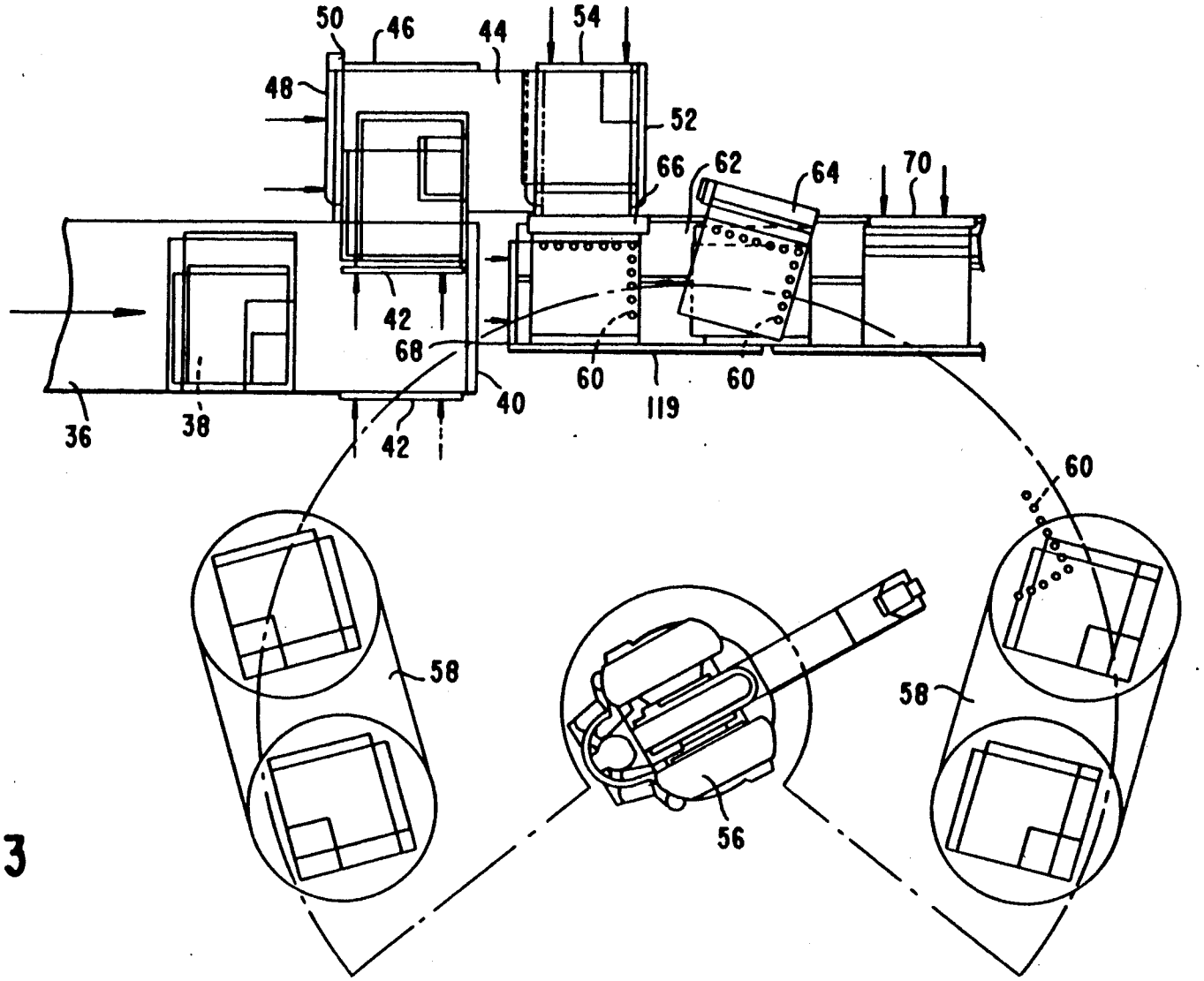
FIG. 3 shows a schematic plan view of the apparatus of the invention.

With reference to the schematic plan view of FIG. 3, the overall apparatus of the invention may be seen to comprise a conventional infeed conveyor 36 along which packages 10 are moved to be inserted into one of receptacle portions 14. In the illustrated embodiment, the edge of each package which is to be first to enter receptacle portion 14 faces downward on conveyor 36, as viewed in FIG. 3. The range of sizes of packages 10 is indicated schematically by a symbol 38 made up of a nest of rectangular shapes corresponding to the various sizes. Packages 10 moving on conveyor 36 eventually engage a fixed stop wall 40 and then are pushed transversely from conveyor 36 by a conventional pusher 42 which moves the packages onto a parallel transfer table 44 where they engage a fixed stop wall 46. Thus, regardless of the size of the package which arrives on conveyor 36, the same two orthogonal edges of the package are oriented by stop walls 40,46. A conventional pusher 48, having a movable guide wall 50, then pushes packages 10 along transfer table 44 until they engage a fixed guide wall 52 which orients a third orthogonal edge of each package; so that, regardless of the size of the package, the package will be properly positioned against fixed guide wall 52 for insertion into receptacle portion 14. A pusher 54, illustrated in detail in FIGS. 4 and 5, moves packages 10 between guide walls 50,52.

A conventional programmable robot 56, preferably of the type having at least five, preferably six, degrees of freedom of movement, such as Model IRB-2000 made by ABB Asea-Brown Boveri, may be used to position container portions 14,24 for receipt of packages 10. The arc-shaped figure overlaid on FIG. 3 illustrates the range of movement in azimuth of robot 56. Suitable storage hoppers or magazines 58, illustrated only schematically, are provided for holding preassembled containers of various sizes. Regardless of the size of the container, one of its corner edges is placed against a fixed stop in its hopper, to enable robot 56 to grasp each container in the same place. Robot 56 is provided with a conventional end effector, not illustrated, preferably having a right angle array of suction cups, indicated schematically by the symbol 60, which can grasp any size container just behind relieved band 34 on receptacle portion 14; so that, closure portion 24 is free to be removed in a manner to be described.

Robot 56 is positioned for ease of access to a container assembly table 62 which is positioned parallel to and at the outfeed end of transfer table 44. Mounted adjacent to assembly table 62 is a means 64 for grasping and holding closure portion 24, as illustrated in detail in FIGS. 8 to 11. Robot 56 removes an assembled container from one of hoppers 58, engages closure portion 24 with grasping and holding means 64 and then withdraws receptacle portion 14 from closure portion 24. Grasping and holding means 64 positions closure portion at an angle to the longitudinal axis of assembly table 62. Empty receptacle portion 14 is then moved by robot 56 into engagement with a means 66 which grasps receptacle portion 14 at relieved band 34 and spreads mouth 20 open, with mouth 20 facing along the path between guide walls 48,52, as illustrated in detail in FIGS. 6 and 7. Robot 56 then releases receptacle portion 14 and withdraws to pickup the next assembled container. Pusher 54 then inserts package 10 into receptacle portion 14 and relieved band 34 is released by grasping means 66.

A conventional pusher 68 associated with assembly table 62 then pushes loaded receptacle portion 14 along assembly table 62 until the leading edge of relieved portion 34 enters mouth 30 and engages edge 32 on closure portion 24. Grasping and holding means 64 then moves with receptacle portion 14 and rotates while holding closure portion 24, until a good telescopic fit is achieved at the position of FIG. 11. Grasping and holding means 64 then releases closure portion 24 and retracts to the position illustrated in FIGS. 3 and 10. Finally, a conventional pusher 70 at the side of assembly table 62 tamps closure portion 24 into full engagement to complete reassembly of the container. The loaded and closed container may then proceed to subsequent processing stations for labelling, sealing and the like.

DELIVERY OF PACKAGES TO CONTAINERS

Figure 2:
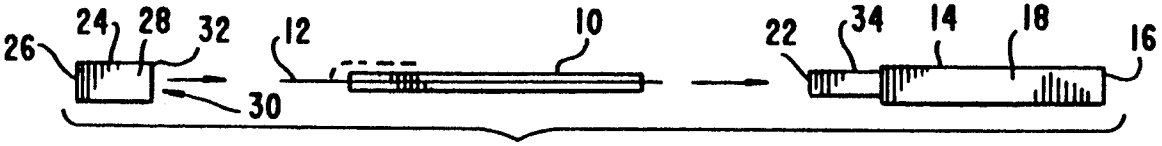
FIG.2 PRIOR ART
FIG. 2 shows an elevation view of the container and package of FIG. 1, illustrating in phantom a folded flap sometimes provided on the package prior to its insertion into the container.
Figure 4:
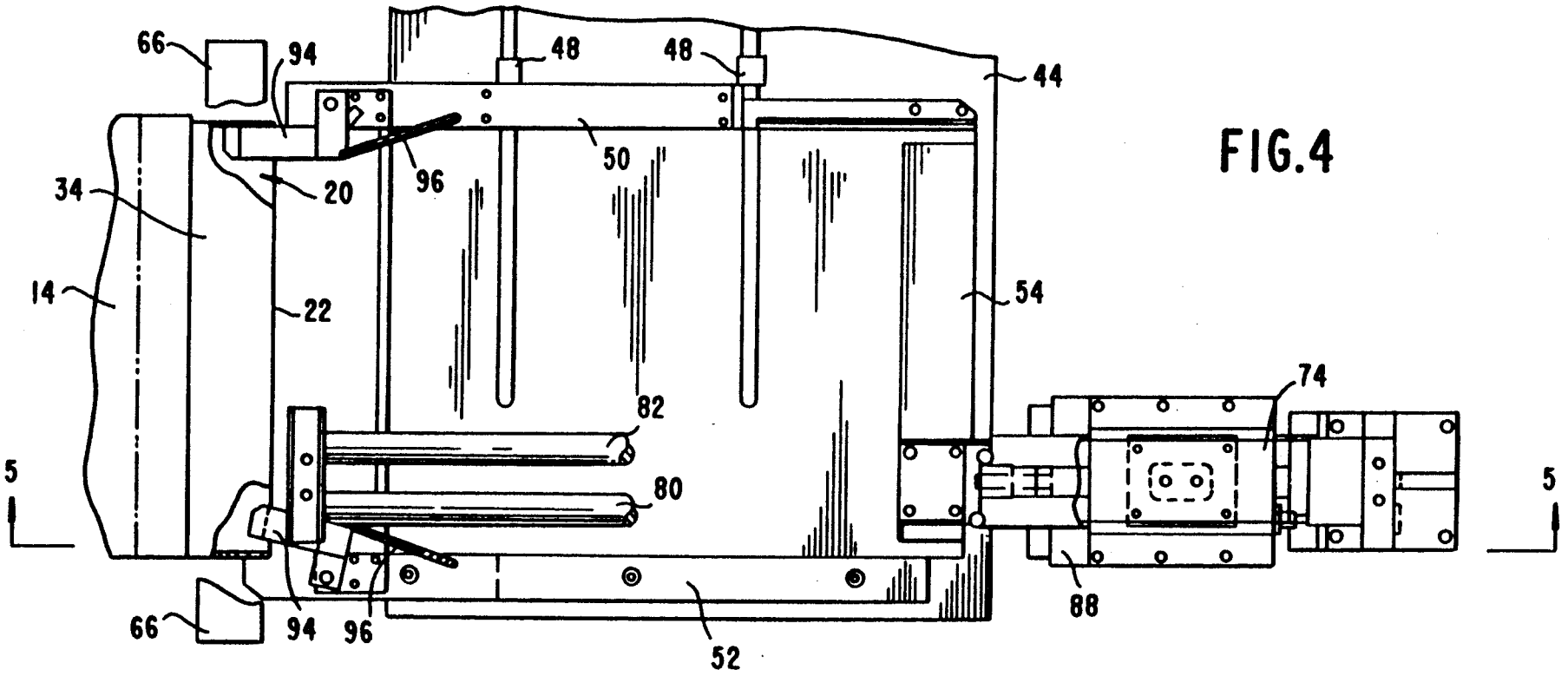
FIG. 4 shows a fragmentary plan view, partially broken away, of the transfer table and pusher which deliver the packages for insertion into the container.
Figure 5:
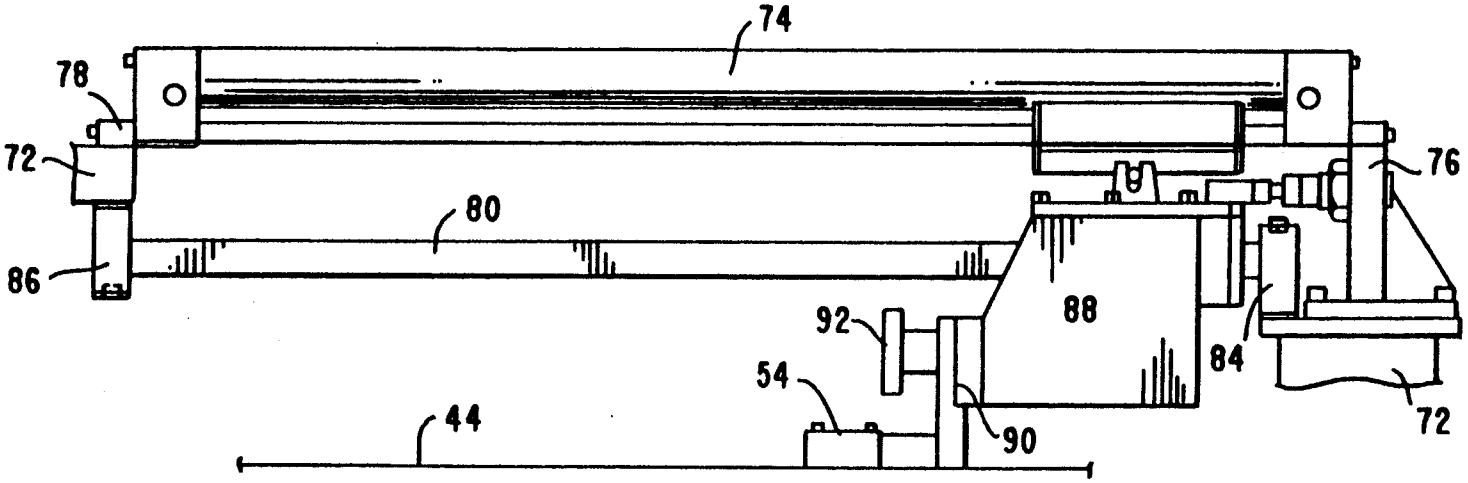
FIG. 5 shows a side elevation view of the apparatus of FIG. 4.

FIGS. 4 and 5 illustrate in greater detail the portions of the apparatus which guide and move packages 10 into their containers. Movable guide wall 50 is pushed across transfer table 44 by pusher 48 which acts through slots in table 44 in the familiar manner. Alternatively, pusher 48 could be actuated from above table 44. Near the outfeed end of transfer table 44, a frame 72, illustrated only fragmentarily, supports the actuating mechanisms for pusher 54. A conventional rodless or band cylinder 74, of the general type sold under the trade name Tol-O-Matic, is mounted on frame 72 parallel to guide walls 50,52 by means of suitable brackets 76,78. Beneath cylinder 74, a pair of parallel rails 80,82 are supported on frame 72 by means of suitable brackets 84,86. Mounted for movement along rails 80,82 is a carriage 88 which is operatively connected to cylinder 74. A bracket 90 supports pusher 54 beneath carriage 88. Pusher 54 extends between guide walls 50,52 and is readily removable from carriage 88 by means of a hand wheel 92, to permit changes in the width of pusher 54 to accommodate packages of different sizes. In cases where package 10 includes a folded flap of the type shown in FIG. 2, pusher 54 may be provided with a retaing plate, not illustrated, which extends over package 10 to hold the flap down as it is inserted into the container Thus, actuation of cylinder 74 causes pusher 54 to move a package 10 toward and into an empty receptacle portion 14 held by grasping means 66 or to retract to the position of FIGS. 4 and 5 to await the next package moved into position by pusher 48 and movable guide wall 50. To ease movement of packages 10 into receptacle portions 14, guide walls 50,52 are each provided at their ends adjacent assembly table 62 with a pivoted guide or "shoe horn" 94. When no package is being pushed past them, guides 94 are held by springs 96 in the inwardly biased position illustrated at the lower portion of FIG. 4; however, when contacted by a passing package, guides 94 move against springs 96 and swing into mouth 20 of receptacle portion 14 where they guide the package during insertion. To seat the package within receptacle portion 14, pusher 54 actually moves through mouth 20 and then, after grasping means 66 looses its hold, pushes the loaded receptacle portion against a stop wall located a short distance across assembly table 62, thus moving the loaded receptacle portion to a location out of the range of engagement with guides 94.

POSITIONING OF RECEPTACLE PORTION

Figure 6:
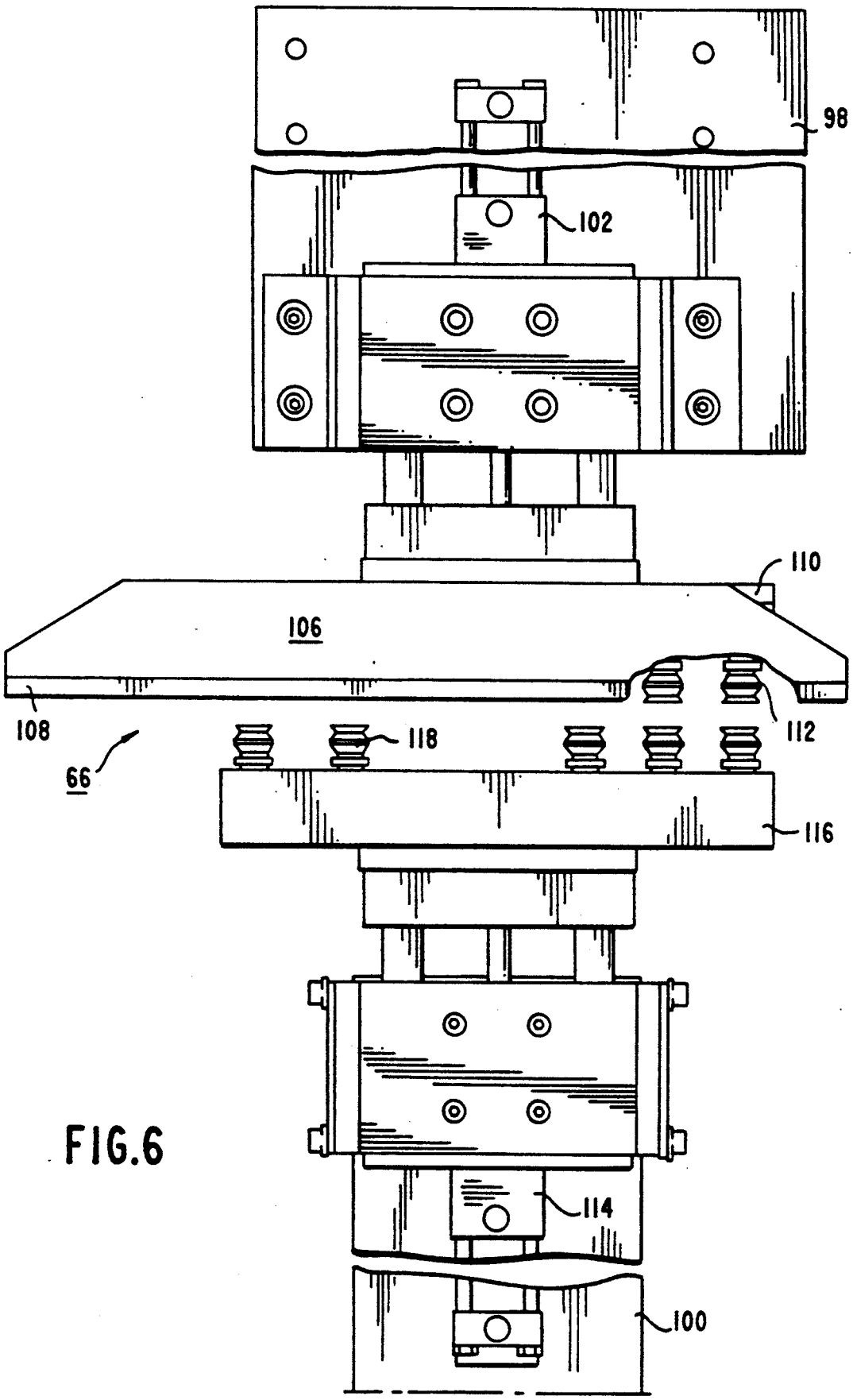
FIG. 6 shows an front elevation view of the apparatus which positions the receptacle portion of the container for insertion of the package.
Figure 7:
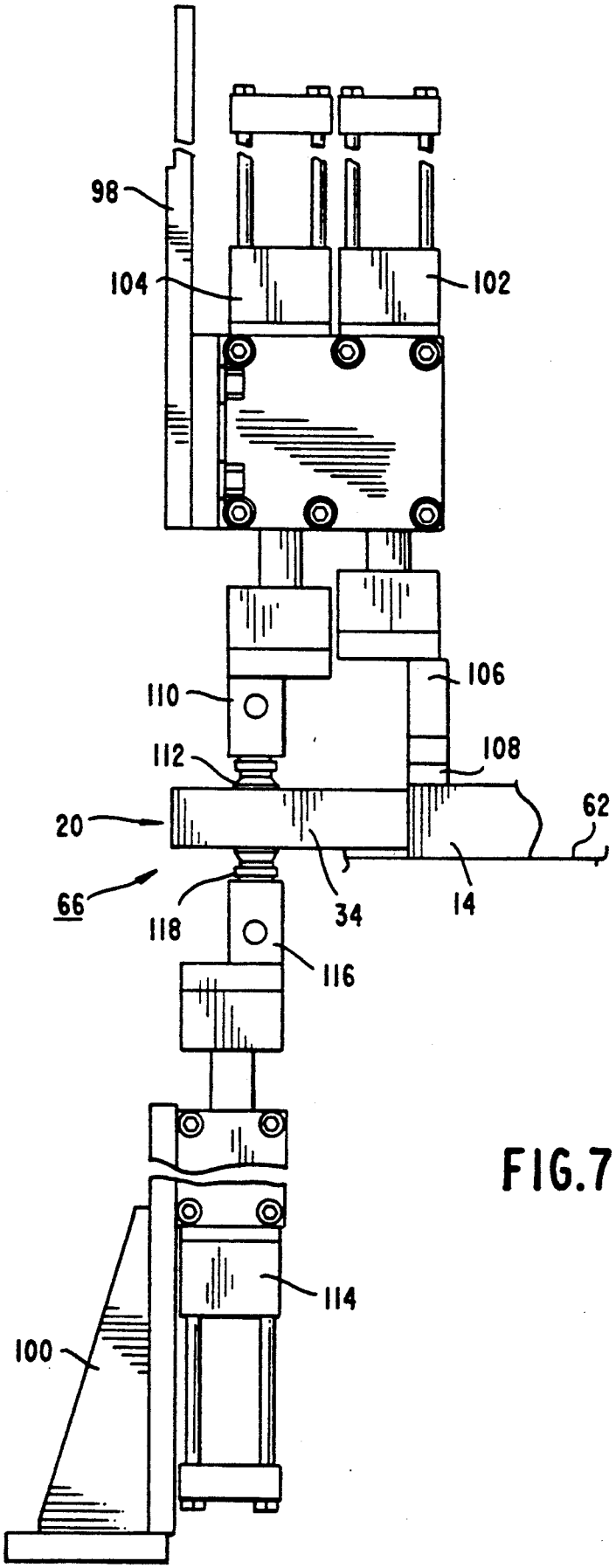
FIG. 7 shows a side elevation view of the apparatus of FIG. 6, as viewed from the left in FIG. 6.
Figure 8:
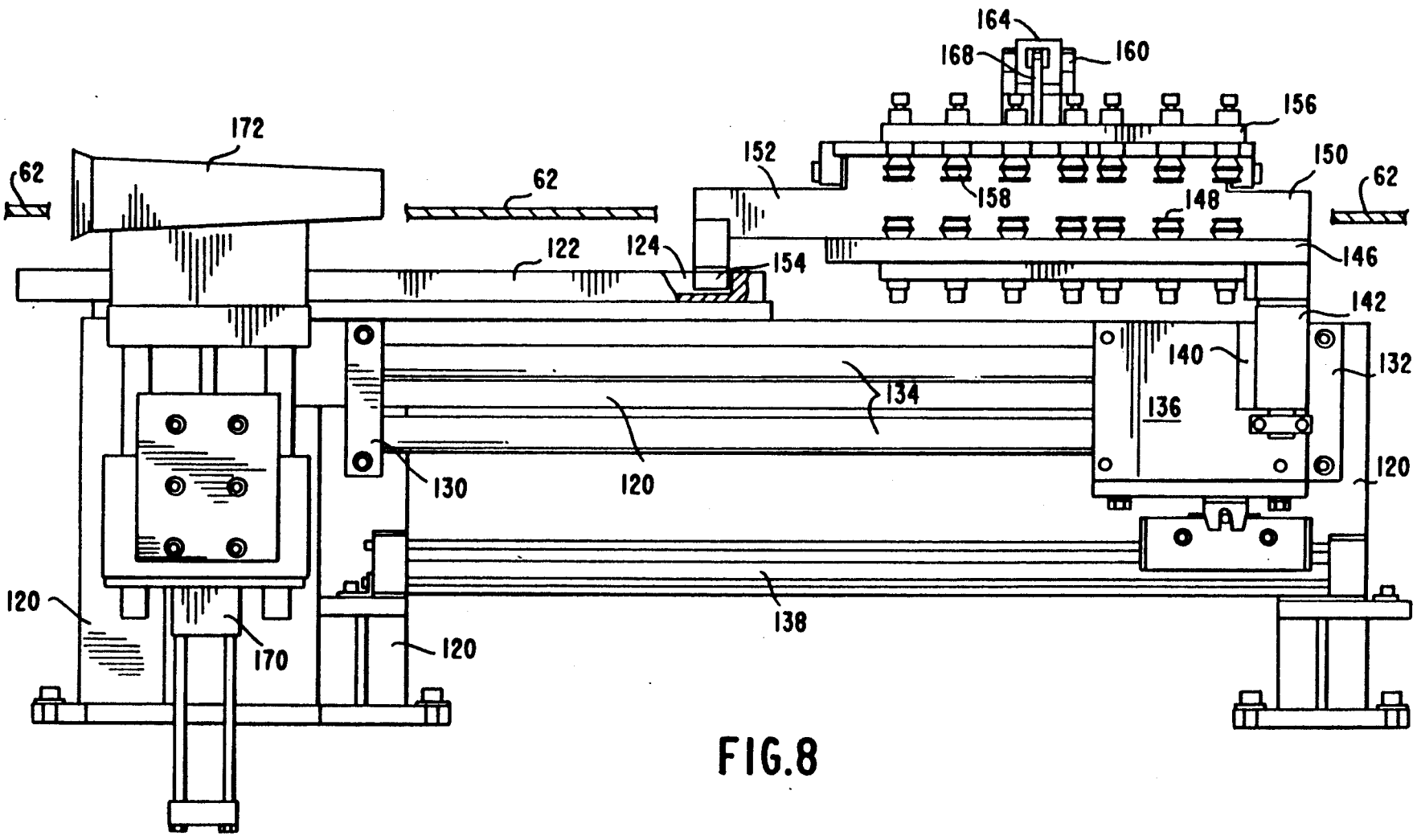
FIG. 8 shows a front elevation view of the apparatus which assembles the top and bottom portions of the container.
Figure 10:
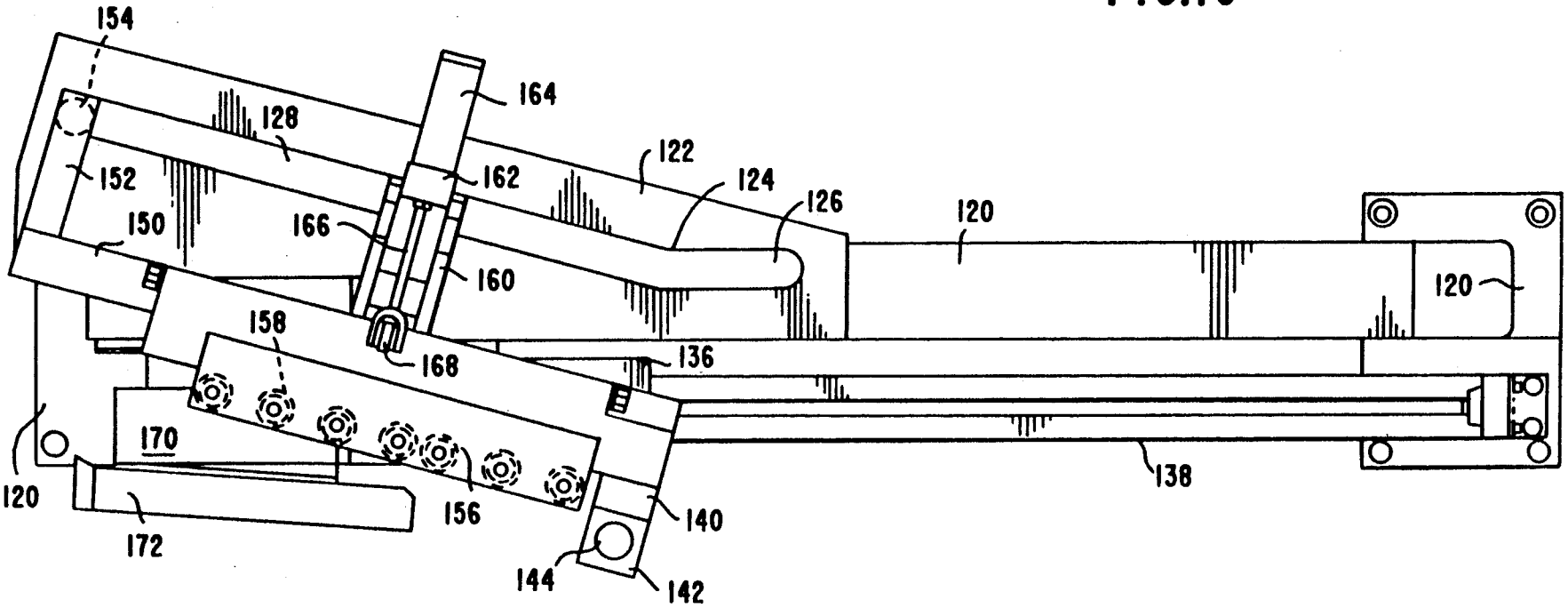
FIG. 10 shows a plan view of the apparatus of FIG. 8, as configured to receive the top portion of the container and to engage the bottom portion after the package has been inserted.
Figure 11:
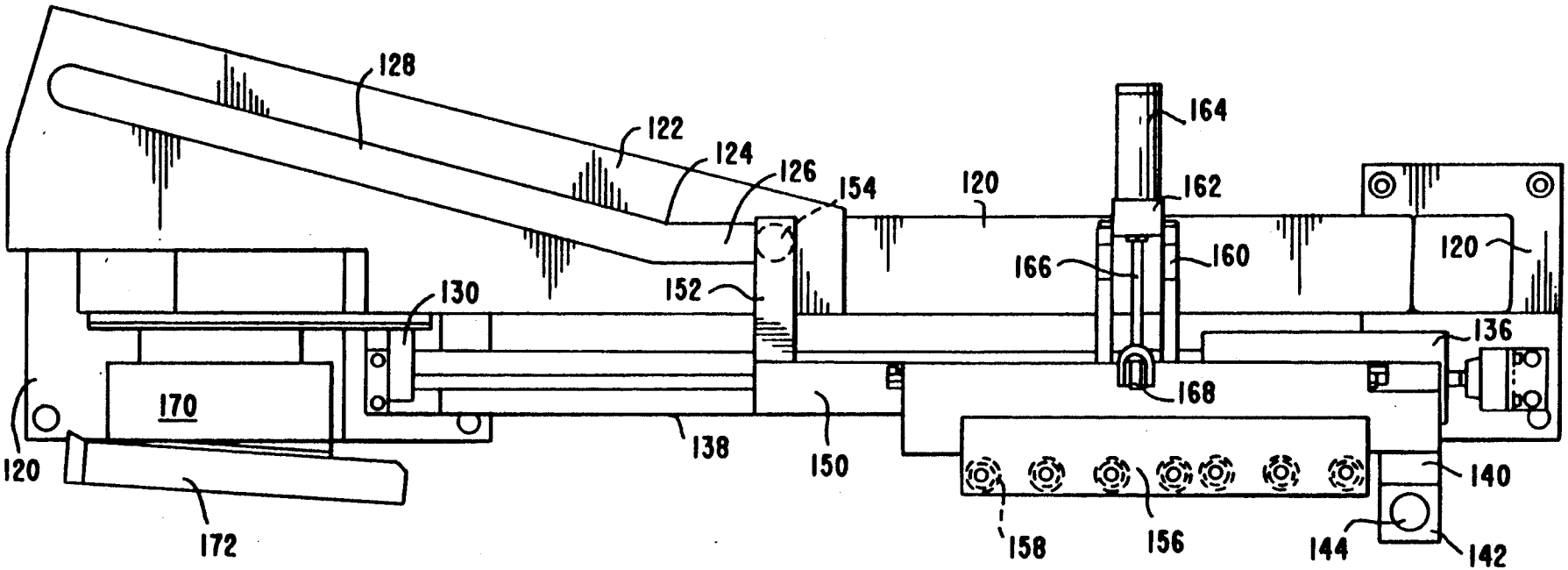
FIG. 11 shows a plan view of the apparatus of FIG. 8, as configured after the top portion of the container has telescopically engaged the bottom portion.

As previously discussed, robot 56 engages each receptacle portion 14 with a grasping means 66 of the type shown in FIGS. 6 and 7. A pair of brackets 98,100 supports the components of the graspong means between transfer table 44 and assembly table 62 by means of attachments to the frame of the apparatus, not illustrated. A front power slide 102 and a rear power slide 104; both of conventional design, are supported on bracket 98. Front power slide 102 comprises a downwardly extended actuator rod which supports a clamp bar 106 having on its lower edge a lip 108 of resilient material such as dense polymeric foam. Lip 108 is positioned transverse to the path between guide walls 50,52 at a location where it can engage receptacle portion 14 just behind relieved band 34. Rear power slide 104 comprises a downwardly extended actuator rod which supports a suction cup bracket 110 which extends parallel to clamp bar 108 and is provided with a linear array of suction cups 112 sufficient in number and length to engage relieved band 34 on containers of various widths. A lower power slide 114 of conventional design is supported on bracket 100 and comprises an upwardly extended actuator rod which supports a suction cup bracket 116 aligned with bracket 110 and provided with a corresponding number of suction cups 118. Receptacle portion 14 is shown fragmentarily as it would be positioned by robot 56. Regardless of the size of receptacle portion 14, robot 56 will position it to cooperate with guide 94 on fixed wall 52 in the manner previously described. Once relieved band 34 has been inserted between suction cups 112,118, front power slide 102 is actuated to lower clamp bar 106 into engagement with receptacle portion 14 and hold it firmly against the upper surface of assembly table 62. The rear power slide 104 and lower power slide 114 are are actuated to engage suction cups 112,118 with relieved band 34, after which brackets 110,116 are withdrawn slightly to bow mouth 20 open somewhat to ease entry of guides 94 and passage of package 10. Once the package is nearly fully inserted by pusher 54, power slides 102, 104 and 114 retract to allow bottom wall 16 to move a short distance into contact with a stop wall 119, illustrated schematically in FIG. 3, on assembly table 62, thereby enabling receptacle portion 14 to move out of engagement with guides 94 and permitting pusher 54 to fully seat the package within the receptacle portion. Power slide 102 is then extended again to clamp the partially completed product while pusher 54 is withdrawn. Power slide 102 then retracts to release the partially completed product for reassembly with closure portion 24.

REASSEMBLING CLOSURE AND RECEPTACLE PORTIONS

After package 10 has been fully inserted into receptacle portion 14, conventional pusher 68 moves the partially completed product along assembly table 62 into engagement with grasping and holding means 64 which is illustrated in FIGS. 8 to 11. A frame 120 positions means 64 adjacent assembly table 62 whose upper surface is indicated fragmentarily in FIGS. 8 and 9. Attached to frame 120 is a horizontal cam plate 122 having a slot 124 with a portion 126 extended essentially parallel to the long axis of assembly table 62 and an angled portion 128 extended outwardly from assembly table in the direction of grasping means 66. Frame 120 comprises upright portions to which are mounted a pair of longitudinally spaced brackets 130,132 which support between them a pair of vertically spaced, parallel and horizontal rails 134. A carriage 136 is mounted for movement along rails 134 and is operatively connected to a conventional rodless or band cylinder 138 supported by frame 120 in a position parallel to rails 134.

A horizontally extended bracket 140 is mounted to carriage 136 and supports at its outer end a bearing assembly 142 having a vertical axis of rotation. A pivot pin 144 is rotatably mounted in bearing assembly 142 and fixedly supports at its upper end one corner of a lower, plate-like suction cup bracket 146 having on its upper surface a linear array of upwardly facing suction cups 148. Along its rear edge, bracket 146 supports an upwardly extended wall member 150 to which a cam bracket 152 is attached at a location essentially diagonally opposite to bearing assembly 142 and pivot pin 144. A cam follower 154 extends downwardly from bracket 152 and into slot 124. Thus, as carriage 136 is pushed along rails 134 by pusher 68 acting through receptacle portion 14, bracket 142 and its supported structure move between the extreme positions illustrated in FIGS. 10 and 11. Cylinder 138 moves carriage 136 from the position of FIG. 11 back to that of FIG. 10 after closure portion 24 has been installed in the manner now to be described.

An upper plate-like suction cup bracket 156 is pivotably mounted to wall member 150 for limited rotation about an axis essentially parallel to the array of suction cups 148. A corresponding array of downwardly facing suction cups 158 is provided on the lower surface of bracket 156, opposite to suction cups 148. To move suction cups 148,158 toward and away from each other, a laterally and upwardly extended support bracket 160 is mounted on wall member 150, to pivotably support the rod end 162 of a pneumatic cylinder 164. The rod 166 of cylinder 164 is pivotably connected to the outer end of an actuator arm formed integrally with upper bracket 156. Thus, when the apparatus is in the configuration of FIG. 10, robot 56 inserts closure portion 24 between suction cups 148,158 with top wall 26 against wall member 150 as shown in FIG. 9. Regardless of the size of closure portion 24, robot 56 will position the downstream corner of the closure portion at a fixed location to enable the closure portion to cooperate with receptacle portion 14. Cylinder 164 is then actuated to extend rod 166 and cause suction cups 148,158 to engage the sides of closure portion 24 and grasp it firmly, thereby permitting robot 56 to withdraw receptacle portion 14 and leave closure portion 24 in place. Cylinder 164 is then actuated to withdraw rod 166 sufficiently to bow outwardly the sides of closure portion 14 and open mouth 30 to facilitate telescopically receiving relieved portion 34 after package 10 has been inserted.

As shown in FIG. 3, grasping and holding means 64 preferably is positioned closely adjacent to grasping means 66, to provide a compact arrangement for the overall apparatus. As pusher 68 moves the partially completed product toward grasping and holding means 64, which is in the position of FIG. 10 at this time, it is desirable to guide the leading edge of relieved portion 34 of receptacle portion 14 into proper engagement with edge 32 surrounding mouth 30 of closure portion 24. Such guidance is provided by a vertically movable power slide 170 mounted on frame 120 in position to support an open sided guide horn 172 at a location beside assembly table 62 and next to grasping means 66. As the partially completed product is pushed along assembly table 62, its lead edge passes into guide horn 172, which ensures that the point engagement will be correct between receptacle portion 14 moving on assembly table 62 and closure portion 24 held by grasping and holding means 64. If the point of engagement is too far down on relieved portion 34, then it may be difficult or impossible to rotate closure portion 24 into telescopic engagement with receptacle portion 14 without damaging one portion or the other due to an interference fit. FIG. 12 shows how the leading edge of relieved portion 34 engages the inside corner of lip 32 at point 174 as receptacle portion 14 is moved by pusher 68. If the fixed inside distance from point 174 to the opposite side of lip 32 is less than the variable distance from point 174 to the outside point 176 on the opposite side of lip 22, then an interference will result as closure portion 24 rotates into engagement with receptacle portion 14 as grasping and holding means 64 moves from the position of FIG. 10 to that of FIG. 11. Grasping and holding means 64 and guide horn 172 prevent such an interference by ensuring that the depth of engagement, or the location of point 174, will be within an acceptable range. Of course, the opposite wall 119 of assembly table 62 also influences the depth of engagement; and simple conventional means, such as a hand wheel mechanism not illustrated, are provided to adjust the location of wall 119 as package and container sizes change. After the partially completed product has moved past guide horn 172, power slide 170 lowers the guide horn below the level of the surface of assembly table 62, to provide adequate clearance for presentation of the next assembled container by robot 56.

ADVANTAGES OF THE INVENTION

The flexible process and apparatus of the invention permit multiple sized containers and packages to be combined with only simple, non-critical adjustments when sizes change. Positively controlling the depth of engagement between receptacle portion 14 and closure portion 24 and then rotating closure portion 24 as both portions move along an assembly surface ensures the assembly of a reliable, quality product. The use of a programmable robot for handling the matched pair containers simplifies changes from size to size.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. Apparatus for assembling a container of the type including a receptacle portion having a bottom wall, a first peripheral wall extended from said bottom wall and a first mouth defined by a first edge of said first peripheral wall opposite said bottom wall, and a closure portion having a top wall, a second peripheral wall extended from said top wall and a second mouth defined by a second edge of said second peripheral wall opposite said top wall, said second mouth being sized to telescopically receive a portion of said first peripheral wall surrounding said first mouth, said apparatus comprising:

means for conveying said receptacle portion along a path with said first edge substantially parallel to said path, whereby a portion of said first edge is leading as said receptacle portion is conveyed;

means for holding said closure portion with said second edge at an angle to said path to permit said portion of said first edge to enter said second mouth and engage said closure portion; and means, operatively connected to said means for holding, for causing said means for holding to rotate and said closure portion to rotate with said means for holding as said closure portion moves along said path with said receptacle portion, so that said second mouth telescopically receives said portion of said first peripheral wall to complete assembly of said container.

2. Apparatus according to claim 1, wherein said means for holding comprises means for opening said second mouth to facilitate entrance of said portion of said first edge.

3. Apparatus according to claim 2, wherein said means for opening comprises a plurality of suction cups for gripping said closure portion on opposite sides of said second mouth.

4. Apparatus according to claim 3, wherein said means for opening further comprises a pair of jaws, each jaw bearing a portion of said plurality of suction cups; and means for closing and opening said jaws to grip and release said closure portion, respectively.

5. Apparatus according to claim 1, wherein said means for holding comprises a carriage mounted for movement adjacent said path, said closure portion being rotatably held on said carriage; and said means for causing comprises a cam follower connected to said means for holding and an elongated cam mounted adjacent said path and engaged with said cam follower, said cam being shaped to cause said means for holding to rotate as said carriage moves along said path.

6. Apparatus according to claim 5, wherein said means for holding comprises means for opening said second mouth to facilitate entrance of said portion said first edge.

7. Apparatus according to claim 6, wherein said means for opening comprises a plurality of suction cups for gripping said closure portion on opposite sides of said second mouth.

8. Apparatus according to claim 7, wherein said means for opening further comprises a pair of jaws, each jaw bearing a portion of said plurality of suction cups; and means for closing and opening said jaws to grip and release said closure portion, respectively.

9. Apparatus according to claim 8, further comprising means for moving said carriage back along said path after release of said closure portion.

10. Apparatus according to claim 1, further comprising means adjacent said path for guiding said portion of said first edge into said second mouth.

11. Apparatus for placing objects in a container of the type including a receptacle portion with a bottom wall, a first peripheral wall extended from said bottom wall and a first mouth defined by a first edge of said first peripheral wall opposite said bottom wall, and a closure portion having a top wall, a second peripheral wall extended from said top wall and a second mouth defined by a second edge of said second peripheral wall opposite said top wall, said second mouth being sized to telescopically receive a portion of said first peripheral wall surrounding said first mouth, said apparatus comprising:

first means for conveying at least one of said objects along a first path;

a fixed guide on one side of said first path;

a movable guide on the other side of said first path;

means for moving said movable guide toward said fixed guide to contact and position said at least one object between said guides on said first means for conveying;

means for positioning said receptacle portion with said first mouth facing along said first path to receive said at least one object from between said guides;

second means for conveying said receptacle portion from said means for positioning along a second path with said first edge substantially parallel to said second path, whereby a portion of said first edge is leading as said receptacle portion is conveyed;

means for holding said closure portion with said second edge at an angle to said second path to permit said portion of said first edge to enter said second mouth and engage said closure portion; and means, operatively connected to said means for holding, for causing said means for holding to rotate as said closure portion moves along said second path with said receptacle portion, so that said second mouth telescopically receives said portion of said first peripheral wall to complete assembly of said container.

12. Apparatus according to claim 11, wherein said means for positioning comprises means for opening said first mouth to facilitate entrance of said at least one object.

13. Apparatus according to claim 12, wherein said means for opening comprises a plurality of suction cups for gripping said receptacle portion on opposite sides of said first mouth.

14. Apparatus according to claim 13, wherein said means for opening further comprises a pair of jaws, each jaw bearing a portion of said plurality of suction cups; and means for closing and opening said jaws to grip and release said receptacle portion, respectively.

15. Apparatus according to claim 11, wherein said receptacle portion and said closure portion originally are provided as an assembled, empty container, further comprising:

means for storing a plurality of said originally assembled, empty containers; and programmable robot means for removing an originally assembled, empty container from said means for storing, for inserting said closure portion into said means for holding, for withdrawing said receptacle portion from said closure portion and for placing said receptacle portion to be engaged by said means for positioning, whereby after insertion of said object, each original receptacle portion is reassembled to each original closure portion.

16. A process for placing objects in containers of the type including a receptacle portion with a bottom wall, a first peripheral wall extended from said bottom wall and a first mouth defined by a first edge of said first peripheral wall opposite said bottom wall, and a closure portion having a top wall, a second peripheral wall extended from said top wall and a second mouth defined by a second edge of said second peripheral wall opposite said top wall, said second mouth being sized to telescopically receive a portion of said first peripheral wall surrounding said first mouth, said receptacle portion and said closure portion orginally being provided as an assembled, empty container, said process comprising the steps of:

conveying at least one of said objects along a first path;

providing a fixed guide on one side of said first path;

providing a movable guide on the other side of said first path;

moving said movable guide toward said fixed guide to contact and position said at least one object between said guides during said conveying step;

removing said closure portion from said receptacle portion;

positioning said receptacle portion with said first mouth facing along said first path to receive said at least one object from between said guides;

inserting said at least one object into said receptacle portion;

conveying said receptacle portion after said inserting along a second path with said first edge substantially parallel to said second path, whereby a portion of said first edge is leading as said receptacle portion is conveyed;

holding said closure portion with said second edge at an angle to said second path to permit said portion of said first edge to enter said second mouth, engage said closure portion, and move said closure portion along said second path and rotating said closure portion while continuing said holding and while moving said closure portion and said receptacle portion along said second path, so that said second mouth telescopically receives said portion of said first peripheral wall to complete assembly of said container, whereby after insertion of said object, each original receptacle portion is reassembled to each original closure portion.

* * * * *